US006498542B1

(12) United States Patent
Kuroda et al.

(10) Patent No.: US 6,498,542 B1
(45) Date of Patent: Dec. 24, 2002

(54) DIELECTRIC RESONANT DEVICE, DIELECTRIC FILTER, DIELECTRIC DUPLEXER, COMMUNICATION APPARATUS INCLUDING THE SAME, AND METHOD FOR FORMING INPUT-OUTPUT ELECTRODE OF THE DIELECTRIC RESONANT DEVICE

(75) Inventors: Katsuhito Kuroda, Matto (JP); Jinsei Ishihara, Kanazawa (JP); Hideyuki Kato, Ishikawa-ken (JP)

(73) Assignee: Murata Manufacturing Co., Ltd. (JP)

( * ) Notice: Subject to any disclaimer, the term of this patent is extended or adjusted under 35 U.S.C. 154(b) by 0 days.

(21) Appl. No.: 09/498,491

(22) Filed: Feb. 3, 2000

(30) Foreign Application Priority Data

Feb. 3, 1999 (JP) ..... 11-025874
Nov. 19, 1999 (JP) ..... 11-329441

(51) Int. Cl.[7] ..... H01P 5/12; H01P 1/202

(52) U.S. Cl. ..... 333/134; 333/202; 333/206; 333/222

(58) Field of Search ..... 333/134, 206, 333/202, 207, 222, 223

(56) References Cited

U.S. PATENT DOCUMENTS 5,488,335 A * 1/1996 Agahi-Kesheh et al. .... 333/206
5,731,753 A * 3/1998 Block ..... 333/222
5,883,554 A * 3/1999 Takeuchi et al. ..... 333/202
6,169,464 B1 * 1/2001 Moon et al. ..... 333/206

FOREIGN PATENT DOCUMENTS

JP 10-190314 7/1998

OTHER PUBLICATIONS

Japanese Office Action dated Apr. 30, 2002 with Abstract.

* cited by examiner

*Primary Examiner*—Robert Pascal
*Assistant Examiner*—Dean Takaoka
(74) *Attorney, Agent, or Firm*—Dickstein, Shapiro, Morin & Oshinsky, LLP.

(57) ABSTRACT

A dielectric resonant device having function of a dielectric filter and a dielectric duplexer having a desired external coupling capacitance includes a substantially rectangular-parallelepipedal dielectric block provided with inner conductive holes therein, and input-output electrodes on the outer surfaces extending from an open surface thereof. Also, a method is provided for forming input-output electrodes of the dielectric resonant device for obtaining a given external coupling capacitance, in which the input-output electrodes are formed by a cutting tool including cutting edges applied to two outer surfaces of the dielectric block along first conductive film removing lines on the two outer surfaces, extending from the open surface, and a cutting edge applied to the two outer surfaces along a second conductive film removing line connecting the first conductive film removing lines.

4 Claims, 4 Drawing Sheets

Prior Art

DIELECTRIC RESONANT DEVICE, DIELECTRIC FILTER, DIELECTRIC DUPLEXER, COMMUNICATION APPARATUS INCLUDING THE SAME, AND METHOD FOR FORMING INPUT-OUTPUT ELECTRODE OF THE DIELECTRIC RESONANT DEVICE

BACKGROUND OF THE INVENTION

1. Field of the Invention

The present invention relates to dielectric resonant devices, such as dielectric filters and dielectric duplexers, including dielectric blocks provided with conductive films disposed on the inner and outer surfaces thereof. The present invention also relates to a communication apparatus using the dielectric resonant devices, and to a method for forming an input-output electrode of a dielectric resonant device.

2. Description of the Related Art

FIG. 5 is a perspective view of a known dielectric filter using a dielectric block. FIG. 5 shows a rectangular-parallelepipedal dielectric block 1. The dielectric block 1 is provided with inner conductor holes 2*a* and 2*b* extending from a surface A to the opposing surface. Each of the inner conductor holes 2*a* and 2*b* includes an inner conductor on the inner surface thereof. The dielectric block 1 is provided with an outer conductor 4 on the five surfaces other than the surface A. The inner conductors are connected to the outer conductor at the surface opposing the surface A. The inner conductors have open ends at the surface A, and are connected to each other at the opposing surface. The dielectric block 1 includes input-output electrodes 5*a* and 5*b* on the outer surfaces, which are separated from the outer conductor 4.

In the known dielectric filter shown in FIG. 5, the input-output electrodes 5*a* and 5*b* are formed by providing regions of the outer conductor separated from the other regions thereof by cutting a part of the outer conductor at predetermined regions by a cutting tool for cutting a conductive film. The method is disclosed in, for example, Japanese Unexamined Patent Application Publication No. 6-310911.

In the dielectric filter prepared by the above-described method, an external Q value (Qe) is determined based on the electrostatic capacitance (external coupling capacitance) between the input-output electrodes and the adjacent inner conductors.

That is, the size of the input-output electrodes is determined according to the characteristics of the dielectric filter to be obtained, which vary according to the external coupling capacitance. In a known method, a cutting tool is required, in which cutting edges are prepared for cutting the conductive film according to each external coupling capacitance to be obtained.

In the known method, therefore, tools having cutting edges in various shapes must be prepared according to each external coupling capacitance desired, resulting in tools having very limited application. Moreover, since the pattern of the input-output electrodes is determined by the position at which the edge of the tool is applied to the outer surface of the dielectric block, the pattern of the input-output electrodes changes as the tool wears out, which causes a problem in that the external coupling capacitance changes from the desired value.

A dielectric filter is proposed, as disclosed in U.S. Pat. No. 5,162,760, in which a side of each input-output electrode is disposed at an open surface of a dielectric block. With this arrangement, desired input-output electrodes can be formed by partially cutting an outer conductor provided on the outer surfaces of the dielectric block.

However, in the dielectric filter disclosed in the above-described U.S. Patent, the following problems occur.

Firstly, electrostatic capacitance between the input-output electrodes and the inner conductors cannot be large because the input-output electrodes are disposed only on a surface of the dielectric block opposing a mounting board (on a bottom surface).

Secondly, because the input-output electrodes are disposed only on a surface of the dielectric block opposing the mounting board (on the bottom surface), isolation cannot be sufficiently ensured due to a short distance between the input-output electrodes provided in a miniaturized dielectric filter.

Thirdly, input-output electrodes on the mounting board cannot be standardized because a pattern of the input-output electrodes on the mounting board must be changed according to the pattern of the input-output electrodes of the dielectric filter which changes according to the area thereof required for the external coupling capacitance determined based on the characteristic of the dielectric filter.

Fourthly, the inspection of a soldered state of the input-output electrodes is difficult because their soldering fillets are difficult to see due to their position, which is the surface of the dielectric block (the bottom surface) opposing the mounting board.

SUMMARY OF THE INVENTION

To overcome the above described problems, preferred embodiments of the present invention provide a dielectric resonant device, a dielectric filter, a dielectric duplexer, and a communication apparatus using the same, in which a desired external coupling capacitance is variably obtained by using one type of cutting tool for cutting a conductive film.

Further, preferred embodiments of the present invention provide a method for forming input-output electrodes of the dielectric resonant device to obtain a given external coupling capacitance.

In accordance with one preferred embodiment of the present invention, a dielectric resonant device is provided which comprises a dielectric block in a substantially rectangular-parallelepipedal shape, including at least one inner conductor therein; and an outer conductor provided on the outer surfaces of the dielectric block except at least one outer surface being an open surface and substantially perpendicular to the axis of the inner conductor. At least one input-output electrode is provided in contact with the open surface to extend over two outer surfaces of the dielectric block adjacent each other, the two outer surfaces being parallel to the axis of the inner conductor.

In the dielectric resonant device according to the invention, the input-output electrode may be formed to be separated from the outer conductor by providing a groove on the surface of the dielectric block.

By providing the input-output electrodes in contact with the open surface, the length of each of the input-output electrodes along the axis of the inner conductor can be determined by using the open surface as a longitudinal end of the input-output electrode and by determining only the position of the other end thereof, thereby enabling the area of a desired pattern of the input-output electrode to be determined. Moreover, maximum electrostatic capacitance between the input-output electrodes and the inner conductors can be ensured to be large by extending the input-output electrodes to an edge of the dielectric block. When miniaturizing the device, a distance between the input-output electrodes disposed on a mounting surface can be kept sufficiently large for maintaining isolation between the input-output electrodes. External coupling capacitance is determined by the area of the input-output electrodes which extend from a mounting surface to the surfaces adjacent thereto of the dielectric block. Therefore, the area of the input-output electrodes can be changed in accordance with a desired external coupling capacitance without changing the pattern thereof on the mounting surface so that input-output electrodes on a mounting board opposing the input-output electrodes on the mounting surface can be standardized in their pattern. With this arrangement, soldering fillets thereof can be checked after the device is mounted on a mounting board.

According to another preferred embodiment of the present invention, a dielectric filter is provided comprising a dielectric resonant device described above, wherein the input-output electrode is provided at two positions, one of the input-output electrodes serving as an input port and the other one of the input-output electrodes serving as an output port. With this arrangement, the input port and the output port of the dielectric resonant device functions as a dielectric filter having a band-pass characteristic.

According to yet another preferred embodiment of the invention, a dielectric duplexer is provided comprising a dielectric resonant device described above, wherein the input-output electrode is provided at three positions, the three input-output electrodes respectively serving as a transmission signal input port, a receiving signal output port, and a transmission-receiving signal input-output port. With this arrangement, the dielectric resonant device may function as a dielectric duplexer (an antenna duplexer), in which the transmission signal input port inputs a transmission signal from a transmission circuit, the transmission-receiving signal input-output port outputs a transmission signal to an antenna and inputs a received signal from the antenna, and the receiving signal output port outputs a received signal to a receiving circuit.

According to yet another preferred embodiment of the present invention, a communication apparatus is provided comprising the dielectric filter and the dielectric duplexer described above. The communication apparatus having excellent high-frequency circuit characteristics includes the dielectric filter or the dielectric duplexer in which desired characteristics are obtainable by setting an external coupling capacitance between the input-output electrodes and the inner conductors at an optimal value. The cost of the communication apparatus may be decreased by using the dielectric filter or the dielectric duplexer which can be produced at a low cost.

According to yet another preferred embodiment of the present invention, a method for forming an input-output electrode of a dielectric resonant device is provided, comprising: providing an inner conductor in a substantially rectangular-parallelepipedal dielectric block; providing an outer conductor on the outer surfaces of the dielectric block except at least one outer surface being an open surface perpendicular to the axis of the inner conductor; and forming an input-output electrode by cutting surfaces of the dielectric block with a cutting tool including cutting edges applied to two outer surfaces of the dielectric block adjacent each other, which are disposed substantially in parallel to the axis of the inner conductor, the cutting edges applied to the two outer surfaces along two first lines, one line on each of the two outer surfaces, extending from the open surface substantially in parallel to the axis of the inner conductor, thereby removing a conductive film along the two first lines, and the cutting tool including a cutting edge applied to the two outer surfaces along a second line connecting the two first lines over the two outer surfaces, thereby removing a conductive film along the second line.

In the above described method, the cutting edges of the cutting tool may be formed in the same length as the maximum length desired of conductive film removing lines extending in parallel to the axis of the inner conductor from the open surface of the dielectric block, whereby the applied position of the cutting tool to the two adjacent outer surfaces of the dielectric block may be selected along the longitudinal direction of the input-output electrodes to form the conductive film removing lines and to provide input-output electrodes extending from the open surface in any desired length. Namely, the external coupling capacitance may be obtained as desired, according to the applied position of the cutting tool to the dielectric block.

DESCRIPTION OF THE PREFERRED EMBODIMENTS

A dielectric filter according to a first embodiment of the present invention is described below, in conjunction with FIG. 1 and FIG. 2.

Figure 1:
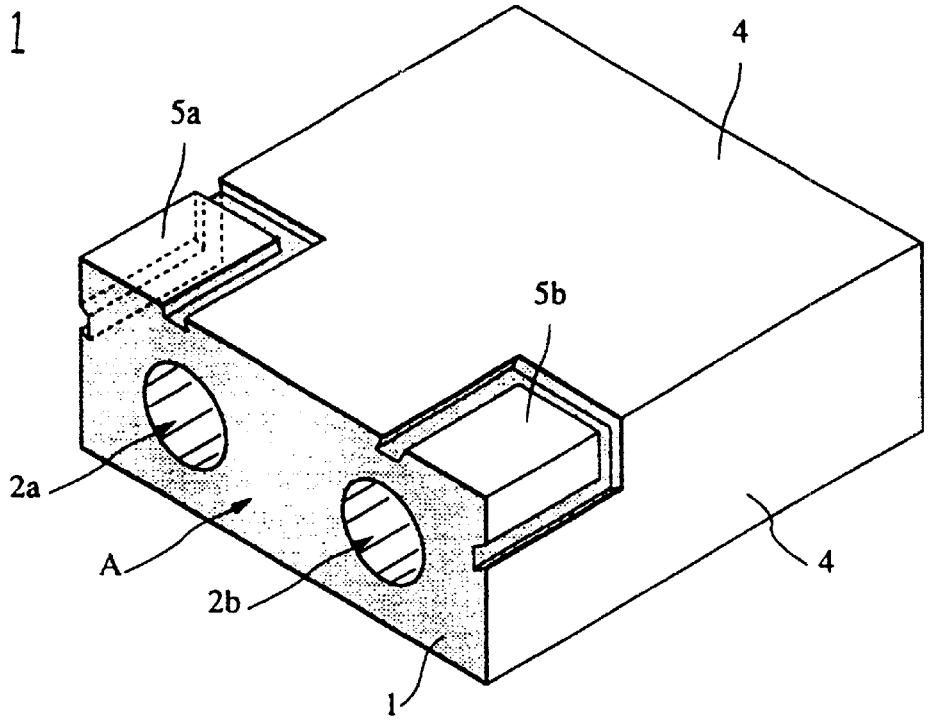
FIG. 1 is a perspective view of a dielectric filter according to a first embodiment of the present invention.

FIG. 1 is a perspective view of the dielectric filter. As shown in FIG. 1, a rectangular-parallelepipedal dielectric block 1 is provided with inner conductor holes 2*a* and 2*b* extending from a surface A to the opposing surface of the dielectric block 1. The inner conductor holes 2*a* and 2*b* are provided with inner conductors on the surfaces thereof. The dielectric block 1 includes an outer conductor 4 formed on the five surfaces other than the surface A, which is an open surface. The inner conductors are connected to each other via the outer conductor 4 provided on the surface opposing the surface A. The dielectric block 1 is provided with input-output electrodes 5*a* and 5*b* formed to be separated from the outer conductor 4 on the outer surfaces of the dielectric block 1.

Two resonant devices provided by the inner conductor holes 2*a* and 2*b* are coupled, in which a difference in resonant frequency of resonant lines of the two inner conductors in an even mode and an odd mode is produced by the difference between the line impedance at the open surface (open side) and the line impedance at the surface on which the inner conductors are connected (connected side). Thus, a filter is provided, including two resonators having different resonant frequencies, which has a band-pass characteristic.

The dielectric filter is mounted, for example, on a circuit board at the upper surface thereof as shown in FIG. 1, which is a mounting surface. The upper surface of the dielectric filter shown in FIG. 1 is opposed to the circuit board and is surface-mounted thereon, the circuit board having electrodes opposing the input-output electrodes 5*a* and 5*b*, and a ground electrode opposing the outer conductor 4.

Figure 2A:
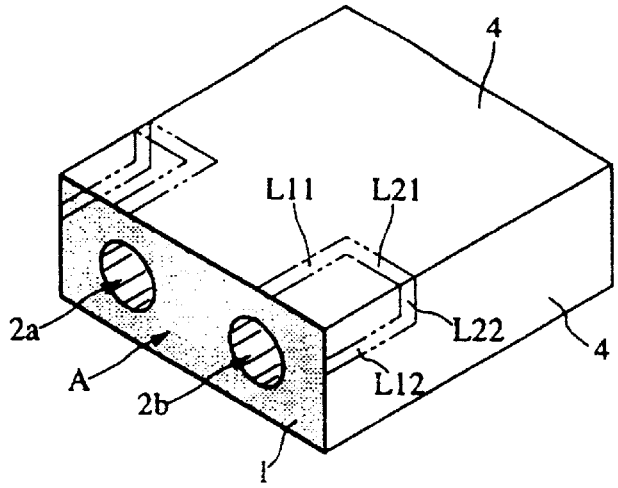
FIG. 2A, FIG. 2B, and FIG. 2C are perspective views of the dielectric filter shown in FIG. 1, which show a method for forming input-output electrodes thereof.
Figure 2B:
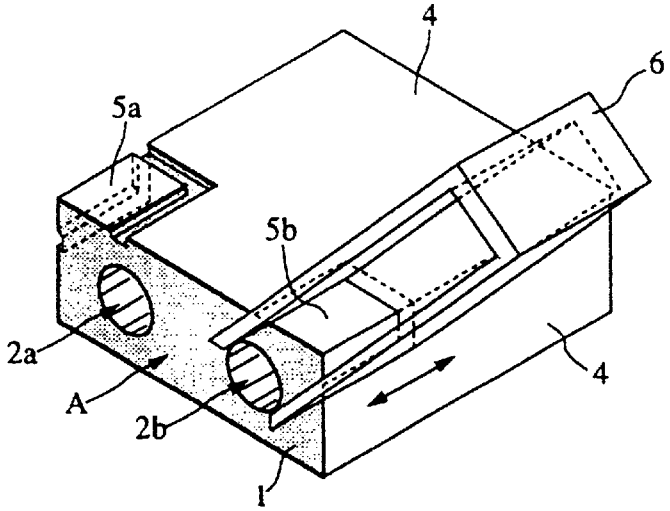
Figure 2C:
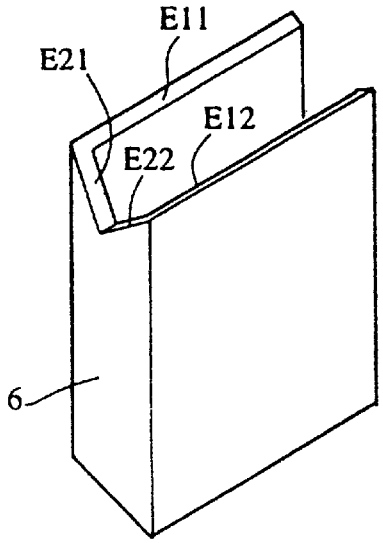

FIGS. 2A, 2B, and 2C are perspective views showing a method for forming the input-output electrodes of the dielectric filter shown in FIG. 1. The dielectric filter shown in FIG. 1 is produced by the following process.

Firstly, a dielectric block 1 is provided as shown in FIG. 2A, which has a substantially rectangular-parallelepipedal shape and passing-through holes therein which serve as inner conductor holes.

Secondly, the dielectric block 1 is provided with conductive films on the six outer surfaces and the inner surfaces of the passing-through holes by electroless plating or the like.

Thirdly, the conductive film provided on the open surface A is removed by grinding over the entire surface.

Fourthly, in the dielectric block 1, conductive film removing lines L11 and L12 are formed on two adjacent surfaces, extending from the open surface A, the two adjacent surfaces being parallel to the axis of the inner conductor hole 2*b* (the axis of the inner conductor), and conductive film removing lines L21 and L22 which connect the conductive film removing lines L11 and L12 are formed in line on the two adjacent surfaces. The input-output electrode 5*b* is thereby formed, enclosed by the open surface A and the conductive film removing lines L11, L12, L21, and L22.

The conductive film removing lines L11, L12, L21, and L22 are formed by a cutting tool 6, applied to the surfaces as shown in FIG. 2B, which is brought into supersonic vibration by a supersonic machining apparatus, thereby removing the outer conductor 4 and a part of the dielectric block 1 at the portion at which the cutting edge of the cutting tool 6 is applied. FIG. 2B shows the process of forming the input-output electrode 5*b*. The input-output electrode 5*a* is formed in the same way.

FIG. 2C is a perspective view of the cutting edge of the cutting tool 6. The cutting edge of the cutting tool 6 includes cutting edges E11 and E12 which are applied to the conductive film removing lines L11 and L12 provided on two adjacent surfaces of the dielectric block 1, extending from the open surface A along the axis of the inner conductor hole 2*b* (the axis of the inner conductor), and cutting edges E21 and E22 which are applied to the conductive film removing lines L21 and L22, connecting the conductive film removing lines L11 and L12, provided on the two adjacent surfaces.

The cutting edges E21 and E22 of the cutting tool 6 are shaped like the letter V, and define the length of the conductive film removing lines L21 and L22 formed on the two surfaces adjacent to the open surface A of the dielectric block 1. The cutting tool 6 is applied to the two surfaces adjacent to the open surface A of the dielectric block 1 at any position thereof selected in the direction along an arrow shown in FIG. 2B. The length of the conductive film removing lines L11 and L12 is defined by the position of the cutting tool 6. The length of each of the conductive film removing lines L11 and L12 defines the external coupling capacitance, the length of each of the conductive film removing lines L11 and L12 being the length of the input-output electrode provided in parallel to the axis of the inner conductor. In other words, a desired characteristic of the filter is obtained by controlling an external coupling capacitance which is controlled by the position at which the cutting tool 6 is applied to the dielectric block 1.

The input-output electrodes 5*a* and 5*b* may be formed by adjusting the length thereof to be formed with a length greater than a designed length, instead of forming the input-output electrodes 5*a* and 5*b* in a designed size in a single cutting process. That is, electrical characteristics such as transmission characteristics, etc., are tested on the filter having input-output electrodes longer by a predetermined length than a designed value, then the external coupling capacitance may be controlled, so that the characteristic value of the filter becomes the designed value, by changing the position of the cutting tool 6 along the longitudinal direction of the input-output electrodes (the direction along the axis of the inner conductors) to form shorter input-output electrodes.

According to the embodiment of the invention, the input-output electrodes 5*a* and 5*b* extending from the mounting surface to the side surfaces of the dielectric block 1 facilitate the checking of soldering fillets thereof when mounted on a mounting board.

When the electrostatic capacitance between the input-output electrodes 5*a* and 5*b* and the inner conductors is desired to be greater, the position of the conductive film removing lines L22 may be changed so that the area of the input-output electrodes becomes greater on the side surfaces which are free from the mounting board. In this case, since the patterns of the input-output electrodes on the mounting surface remain unchanged, the distance between the input-output electrodes on the mounting surface does not become shorter when the device is miniaturized, thereby ensuring isolation between the input-output electrodes. Moreover, input-output electrodes at a mounting-board side may be standardized in size by regularizing the size of the input-output electrodes on the mounting surface of the dielectric block 1, which is enabled by controlling the external coupling capacitance with the area of the input-output electrodes at the side surfaces of the dielectric block.

A dielectric duplexer according to a second embodiment of the present invention is described below with reference to FIG. 3.

Figure 3A:
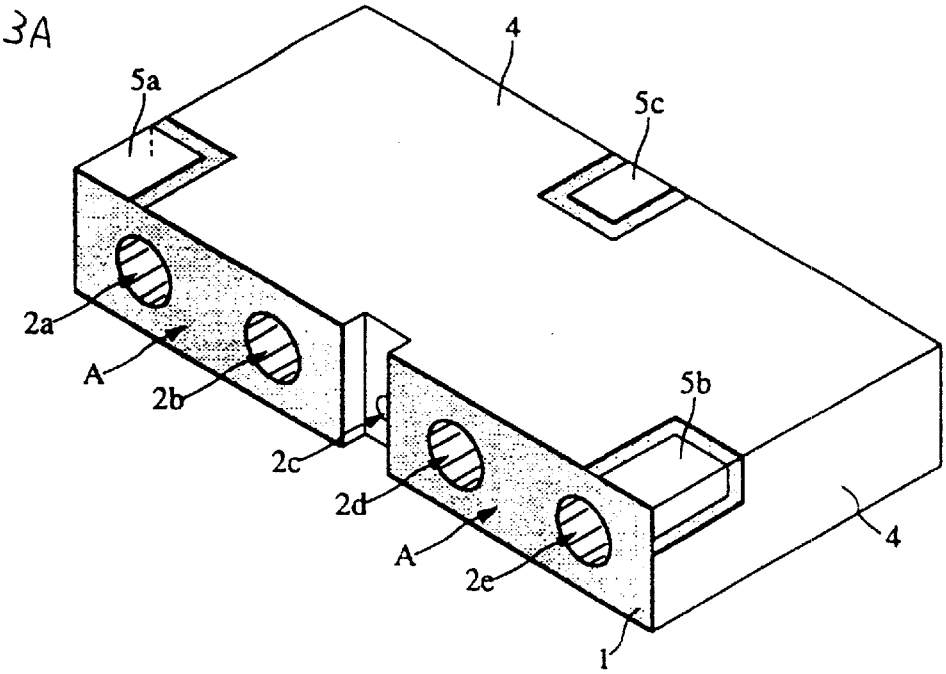
FIG. 3A and FIG. 3B are illustrations of a dielectric duplexer according to a second embodiment of the present invention.
Figure 3B:
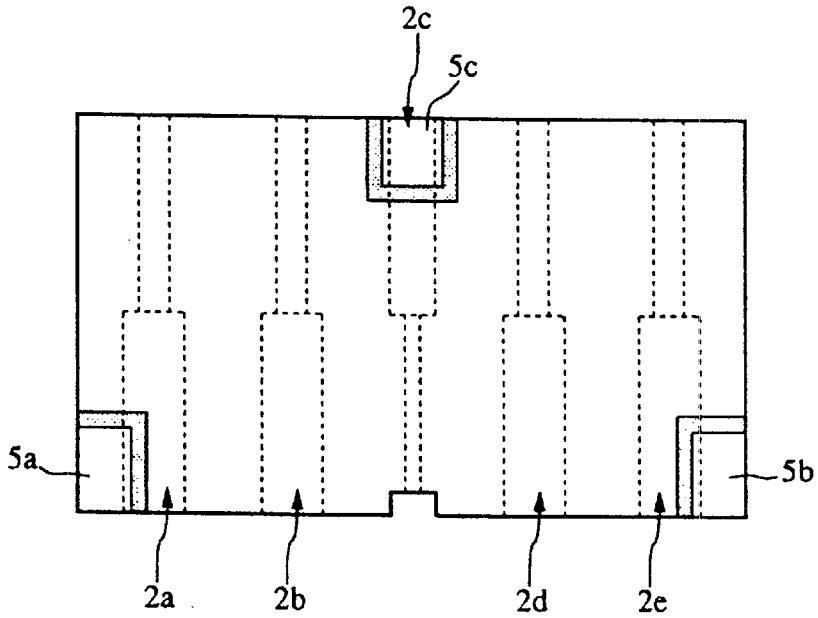

FIG. 3A is a perspective view of the dielectric duplexer according to the embodiment, and FIG. 3B is a top view thereof. A rectangular-parallelepipedal dielectric block 1 shown in FIGS. 3A and 3B is provided with inner conductor holes 2*a*, 2*b*, 2*d*, and 2*e* passing from a surface referred to with the letter A through to the opposing surface thereof. The inner conductor holes 2*a*, 2*b*, 2*d*, and 2*e* are provided with inner conductors on the surfaces thereof. An external conductor 4 is formed on the five external surfaces other than the surface A, which is an open surface, of the dielectric block 1. The surface opposing the open surface A serves as a connecting surface.

The dielectric block 1 is provided with an inner conductor hole 2*c* at an intermediate portion thereof. The inner conductor hole 2*c* includes an inner conductor therein having a connecting end at the front surface shown in FIG. 3A and an open end at the surface opposing the front surface of the dielectric block 1. The dielectric block 1 is provided with an input-output electrode 5*c* extending from the open end of the inner conductor to the upper surface of the dielectric block 1. The dielectric block 1 is also provided with input-output electrodes 5*a* and 5*b* at the outer surface thereof, formed to be separated from the outer conductor 4. The input-output electrodes 5*a*, 5*b*, and 5*c* are formed by cutting off the surface of the dielectric block 1 together with a part of the dielectric block 1, thereby forming grooves in the dielectric block 1. The grooves are not shown in a concave form in FIGS. 3A and 3B.

The inner conductor holes 2*a* and 2*b* provide two resonators, coupled in the same manner as described in the first embodiment, which operate as a filter having a band-pass characteristic. The inner conductor holes 2*d* and 2*e* provide two other resonators, coupled in the same manner, which operate as a filter having a band-pass characteristic.

The inner conductors included in the inner conductor holes 2*b* and 2*c* are interdigitally coupled with each other. In the same way, the inner conductors included in the inner conductor holes 2*c* and 2*d* are interdigitally coupled with each other. With this arrangement, a dielectric duplexer is provided including the input-output electrode 5*a* serving as a transmission signal input port, the input-output electrode 5*b* serving as a receiving signal output port, and the input-output electrode 5*c* serving as an output-input port to and from an antenna.

The input-output electrodes 5*a* and 5*b* shown in FIGS. 3A and 3B are formed by the same processes as described according to the first embodiment, as shown in FIGS. 2A, 2B, and 2C. In these processes, an external Q value (Qe) of the transmission filter and an external Q value (Qe) of the receiving filter are determined as desired.

Figure 4:
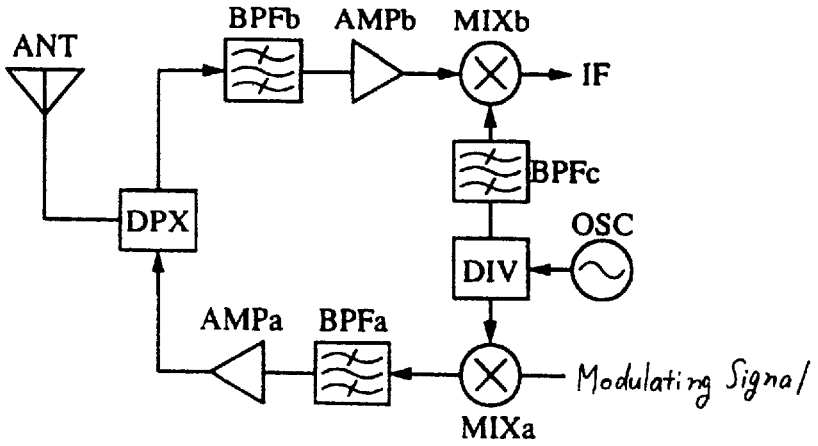
FIG. 4 block diagram of a communication apparatus according to a third embodiment of the present invention.
Figure 5:
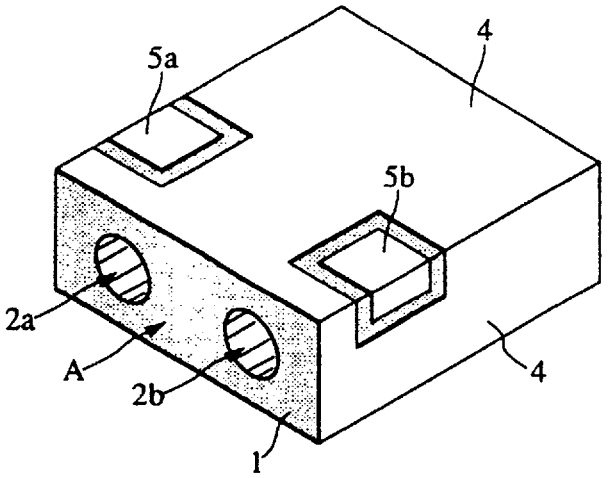
FIG. 5 is a perspective view of a known dielectric filter.

A communication apparatus according to a third embodiment of the present invention is described as follows with reference to FIG. 4. FIG. 4 is a block diagram of a configuration including a transmitting/receiving antenna ANT, a duplexer DPX, band-pass filters BPFa, BPFb, and BPFc, amplifying circuits AMPa and AMPb, mixers MIXa and MIXb, an oscillator OCS, and a frequency divider (a synthesizer) DIV. The mixer MIXa modulates a frequency signal from the frequency divider DIV according to a modulating signal, the band-pass filter BPFa transmits only a transmit frequency band which is power-amplified by the amplifying circuit AMPa to be transmitted through the duplexer DPX and the antenna ANT. The band-pass filter BPFb transmits only a receiving frequency band from a signal outputted by the duplexer DPX, which is amplified by the amplifying circuit AMPb. The mixer MIXb mixes the frequency signal from the band-pass filter BPFc and the receiving signal, and outputs a synthesized intermediate frequency signal IF.

The dielectric duplexer shown in FIGS. 3A and 3B may be used as the duplexer DPX shown in FIG. 4. The dielectric filter shown in FIG. 1 may be used as the band-pass filter BPFa, BPFb, or BPFc. A miniaturized communication apparatus is provided as described above.

According to the first embodiment of the present invention, as described above, by providing the input-output electrodes in contact with the open surface, the length of each of the input-output electrodes along the axis of the inner conductor can be determined by using the open surface as a longitudinal end of the input-output electrode and by determining only the position of the other end thereof, thereby enabling the area of a desired pattern of the input-output electrode to be determined. Moreover, maximum electrostatic capacitance between the input-output electrodes and the inner conductors can be ensured to be large by extending the input-output electrodes to an edge of the dielectric block. When miniaturizing the device, a distance between the input-output electrodes disposed on a mounting surface can be kept sufficiently large for maintaining isolation between the input-output electrodes. External coupling capacitance is determined by the area of the input-output electrodes which extend from the mounting surface to the surfaces adjacent thereto of the dielectric block. Therefore, the area of the input-output electrodes can be changed in accordance with a desired external coupling capacitance without changing the pattern thereof on the mounting surface, so that input-output electrodes on a mounting board opposing the input-output electrodes on the mounting surface can be standardized in their pattern. With this arrangement, soldering fillets thereof can be checked after the device is on a mounting board.

According to the first embodiment, a dielectric filter can be obtained, which has an optimal external coupling capacitance at the input port and the output port.

According to the second embodiment, a dielectric duplexer can be obtained which has an optimal external coupling capacitance at the input port and the output port.

According to the third embodiment of the invention, a communication apparatus having excellent high frequency circuit characteristics can be obtained, which includes the dielectric filter or the dielectric duplexer having an optimal external capacitance according to desired filtering characteristics. The cost of the communication apparatus may be decreased by using the dielectric filter or the dielectric duplexer which can be produced at a low cost.

In the method for forming the input-output electrodes in the dielectric block according to the present invention, the input-output electrodes, which extend from the open surface, can be formed by applying the cutting tool to the two adjacent outer surfaces of the dielectric block at any position thereof. According to the applied position of the cutting tool, a desired external coupling capacitance can be obtained.

While the invention has been particularly shown and described with reference to preferred embodiments thereof, it will be understood by those skilled in the art that the forgoing and other changes in form and details may be made therein without departing from the spirit of the invention.

What is claimed is:

1. A dielectric duplexer, comprising:

a dielectric block having a substantially rectangular-parallelepiped shape and including at least one axially extending inner conductor therein;

an outer conductor provided on a plurality of outer surfaces of the dielectric block but not on an open outer surface of the dielectric block which lies substantially perpendicular to an axis of the axially extending inner conductor;

a first input/output electrode located on a first pair of adjacent outer surfaces of the dielectric block, the adjacent outer surfaces extending parallel to the axis of the inner conductor, the first input/output electrode being separated from the outer conductor by a groove which extends into the first pair of adjacent outer surfaces;

a second input/output electrode located on a second pair of adjacent outer surfaces of the dielectric block, the adjacent outer surfaces extending parallel to the axis of the inner conductor, the second input/output electrode being separated from the outer conductor by a second groove which extends into the second pair of adjacent outer surfaces; and a third input/output electrode located on an outer surface of the dielectric block and on the opposite side of the dielectric block from the first and second input/output electrodes, the outer conductor being disposed between the first and second grooves.

2. The dielectric duplexer of claim 1, wherein each of the first, second and third input/output electrodes are located on a mounting surface of the dielectric block.

3. A communication apparatus, comprising:

a transmitting circuit;

a receiving circuit;

an antenna; and a dielectric duplexer, comprising:

a dielectric block having a substantially rectangular-parallelepiped shape and including at least one axially extending inner conductor therein;

an outer conductor provided on a plurality of outer surfaces of the dielectric block but not on an open outer surface of the dielectric block which lies substantially perpendicular to an axis of the axially extending inner conductor;

a first input/output electrode located on a first pair of adjacent outer surfaces of the dielectric block, the first pair of adjacent outer surfaces extending parallel to the axis of the inner conductor, the first input/output electrode being separated from the outer conductor by a first groove which extends into the first pair of adjacent outer surfaces, the first input/output electrode coupled to the transmitting circuit;

a second input/output electrode located on a second pair of adjacent outer surfaces of the dielectric block, the second pair of adjacent outer surfaces extending parallel to the axis of the inner conductor, the second input/output electrode being separated from the outer conductor by a second groove which extends into the second pair of adjacent outer surfaces, the second input/output electrode being coupled to the receiving circuit; and a third input/output electrode located on an outer surface of the dielectric block and on the opposite side of the dielectric block from the first and second input/output electrodes, the third input/output electrodes being coupled to the antenna, the outer conductor being disposed between the first and second grooves.

4. The communication apparatus of claim 3, wherein each of the first, second and third input/output electrodes are located on a mounting surface of the dielectric block.

* * * * *